US006719470B2

(12) United States Patent
Berhin

(10) Patent No.: US 6,719,470 B2
(45) Date of Patent: Apr. 13, 2004

(54) PEN

(75) Inventor: Johan Berhin, Malmö (SE)

(73) Assignee: Anoto AB, Lund (SE)

( * ) Notice: Subject to any disclaimer, the term of this patent is extended or adjusted under 35 U.S.C. 154(b) by 0 days.

(21) Appl. No.: 10/118,063

(22) Filed: Apr. 9, 2002

(65) Prior Publication Data

US 2003/0002911 A1 Jan. 2, 2003

Related U.S. Application Data

(60) Provisional application No. 60/285,996, filed on Apr. 25, 2001.

(30) Foreign Application Priority Data

Apr. 9, 2001 (SE) ..... 0101242

(51) Int. Cl.[7] ..... B43K 5/16

(52) U.S. Cl. ..... 401/104; 401/195; 401/243; 401/117

(58) Field of Search ..... 401/104, 195, 401/243, 99, 117, 52

(56) References Cited

U.S. PATENT DOCUMENTS

| | | | | |
|---|---|---|---|---|
| 454,064 A | * | 6/1891 | Pfeiffer | 401/95 |
| 3,985,457 A | | 10/1976 | Paroty | |
| 4,892,428 A | * | 1/1990 | Grotsch | 401/243 |
| 4,952,088 A | | 8/1990 | Groetsch | |
| 4,981,383 A | * | 1/1991 | Grotsch et al. | 401/195 |
| 5,294,792 A | | 3/1994 | Lewis et al. | |
| 5,434,371 A | | 7/1995 | Brooks | |
| 5,852,434 A | | 12/1998 | Sekendur | |
| 6,104,388 A | | 8/2000 | Nagai et al. | |
| 6,130,666 A | | 10/2000 | Persidsky | |

FOREIGN PATENT DOCUMENTS

| | | |
|---|---|---|
| EP | 0 657 301 A1 | 6/1995 |
| EP | 0 657 306 A1 | 6/1995 |
| GB | 2 001 696 | 2/1979 |
| WO | WO 00/73983 A1 | 12/2000 |

* cited by examiner

*Primary Examiner*—David J. Walczak
(74) *Attorney, Agent, or Firm*—Birch, Stewart, Kolasch & Birch, LLP

(57) ABSTRACT

A pen comprising a pen body (1) and a pen point (3) releasably arranged in the pen body, and a part (4) which is removably arranged on the pen body (1). The part (4) is arranged for squeezing engagement with the pen point (3), for removing the same by the action of forces between the part (4) and the pen point (3). A method for removing the pen point and a clip for holding the pen are also described.

16 Claims, 4 Drawing Sheets

PEN

This application claims priority on provisional Application No. 60/285,996 filed on Apr. 25, 2001, the entire contents of which are hereby incorporated by reference.

FIELD OF THE INVENTION

The invention relates to a pen of the type stated in the preamble to claims 1 and 19. Moreover the invention relates to a method for removing a pen point according to the preamble to claim 16 and a clip according to the preamble to claim 20.

BACKGROUND ART

A type of pen which occurs frequently on the market has a pen body with an ink stick which is removably arranged therein and which at its one end has a pen point and is insertable and extractable through the open end of the pen body. An ink cartridge with a pen point is referred to as ink stick. Access is gained to the ink stick by removing a nose cone which is screwably arranged on the front part of the pen body and which, when being unscrewed, leaves such a long part of the cartridge behind that the user can remove the cartridge by hand from the pen body when, for instance, exchanging the cartridge. The nose cone has a plurality of drawbacks. It must be unscrewed, which makes the exchange of the ink cartridge difficult. The nose cone is a loose part which can easily be lost when exchanging the ink cartridge. Moreover the nose cone makes the manufacture of the pen more expensive.

U.S. Pat. No. 4,952,088 shows how a clip arranged on the cap of the pen can be used for form-fit engagement with a specially adapted nose cone, the clip/cap serving as a lever to unscrew the nose cone from the pen body. A problem of the clip according to U.S. Pat. No. 4,952,088 is that the pen point must be specially designed or alternatively must be combined with a nose cone. Moreover the possibilities of designing the pen are limited by the construction of the clip.

EP-0 657 301 A1 shows how a pen point can be extracted from a pen body with the aid of an engaging means arranged on the cap. The engaging means is designed for form-fit engagement with a specially adapted groove in an adaptor sleeve mounted around the pen point. Some problems of the engaging means according to EP-0 657 301 A1 are its restriction of the possibilities of designing the pen, the risk of it getting stuck, for instance, in the user's clothes, and the necessary cooperation with a specially adapted adaptor sleeve.

Besides conventional writing materials, also so-called digital pens have recently been developed, which contain sensors and electronics for digital recording of what is being written by means of the pen on a base. Different types of sensors can be arranged in the pen for determining its position, for instance acceleration sensors, as disclosed in U.S. Pat. No. 5,434,371 and U.S. Pat. No. 6,130,666, optical sensors, as described in U.S. Pat. No. 5,294,792, U.S. Pat. No. 5,852,434 and WO 00/73983, pressure sensors, as described in U.S. Pat. No. 6,104,388, or mechanical sensors, as described in U.S. Pat. No. 5,294,792 and U.S. Pat. No. 6,130,666. For reasons of security, the pen body of such digital pens is frequently designed to prevent access to the interior of the pen and the sensitive components therein. The ink stick is therefore inserted into a duct extending into the pen body from its writing end. Like in ordinary pens of this type, it is difficult for the user to exchange the ink stick, whether the pen has a nose cone or not.

SUMMARY OF THE INVENTION

Thus the present invention relates to a pen of the type described by way of introduction, which solves the above problems, the pen having obtained the features as defined in the respective characterizing clauses of claims 1 and 19.

The present invention further relates to a method for removing a pen point of the type described above, the method having obtained the features as defined in the characterizing clause of claim 16.

The present invention also relates to a clip for holding a pen of the type described above when carried in a user's pocket, the clip having obtained the features as defined in the characterizing clause of claim 20.

BRIEF DESCRIPTION OF THE DRAWINGS

Embodiments of the invention according to its different aspects are evident from the dependent claims and the following description, reference being made to accompanying schematic drawings.

DETAILED DESCRIPTION OF EMBODIMENTS OF THE INVENTION

Figure 1:
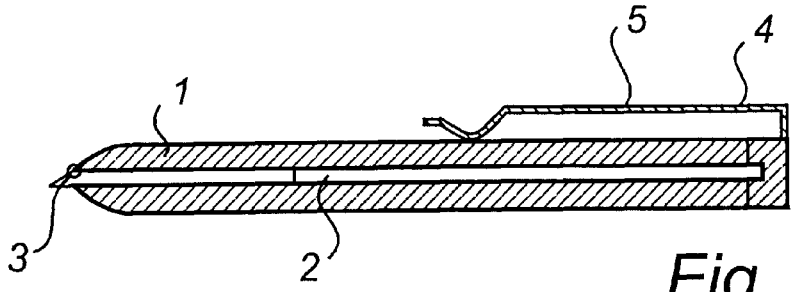
FIG. 1 is a longitudinal sectional view of an embodiment of a pen according to the invention.

With reference to FIG. 1, an embodiment of a pen according to the invention is shown, comprising a pen body 1, an ink cartridge arranged in the pen body and having a pen point 3 and a part, such as a clip 4, which is removably arranged on the pen body 1.

The ink cartridge 2 and the pen point 3 may form an ink stick which is exchangeable in its entirety. Alternatively, the pen point 3 can be inserted into the ink cartridge 2 and define a distinguishable part, filling of the ink cartridge 2 being allowed after removal of the pen point 3.

In the embodiment according to FIG. 1, the pen point 3 or the ink stick in its entirety can be releasably arranged in the pen body 1 in various ways.

According to one embodiment, it is possible to use some kind of fit between complementary elements which may be arranged projecting from the inner wall of the pen body 1 and/or from the pen point/ink stick, and which may cooperate to cause locking or anchoring of the pen point or ink stick, which anchoring can be released under the action of a pulling force exerted on the pen point 3. Such elements may comprise, for instance, flaps, beads etc. Alternatively, it is possible to form the inside of the pen body so that the pen point or ink stick is kept in place by press fit, which can also be neutralized under the action of a pulling force.

Various examples of means for adequate exertion of the above-mentioned pulling force follow below. In all cases, these means are included in a part which is removably arranged on the pen body 1. A common feature of the following exemplifying embodiments is that they allow squeezing engagement with the pen point, so that the pen point can be extracted from the pen body, for instance for exchanging the ink stick or for filling the ink cartridge. The application of the pulling force can, via the squeezing engagement, be executed independently of the nature of the pen point. If the pen point has, for instance, an essentially smooth peripheral surface, the squeezing engagement may result in a frictional force which is sufficient to allow application of the pulling force. If the pen point instead has a profiled peripheral surface, the component or components applying squeezing forces may engage arbitrary protrusions, grooves, flaps etc. on the peripheral surface.

The accompanying drawings illustrate several examples of how the squeezing engagement can be performed.

According to FIGS. 2A and 3–5, the clip can be provided with a hole in the form of a through hole. According to FIGS. 2C and 7, the clip and a protective cap, respectively, can be provided with a hole in the form of a blind hole. By "blind hole" is meant a non-through hole.

The shown holes in the form of through holes and blind holes may have a constant cross-section in depth. Alternatively, this cross-section may vary (not shown) over the depth of the hole. Thus, the hole can be tapering or widening in depth. The openings of a through hole may also be of different configurations, for instance different sizes or shapes.

Figure 2A:
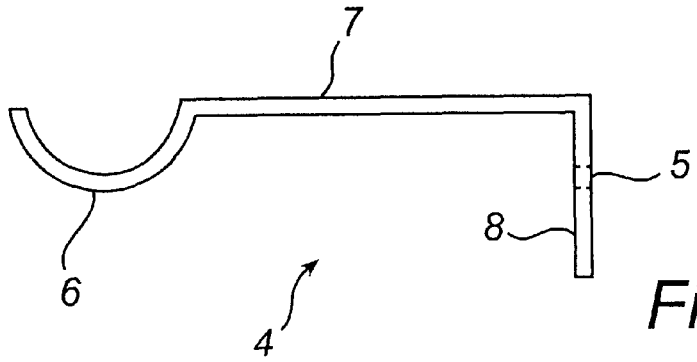
FIGS. 2A–2C are side views of releasable clips according to different embodiments of the invention.
Figure 2B:
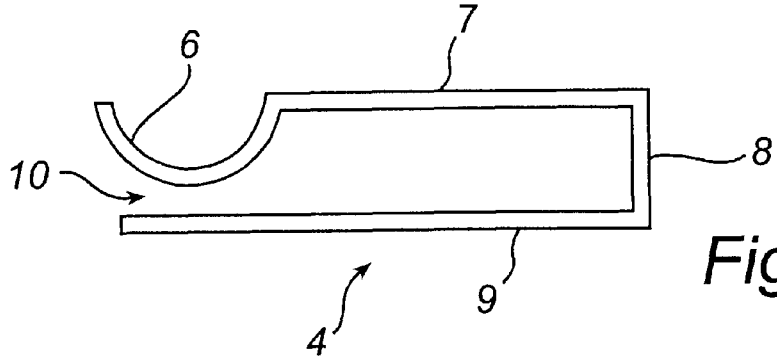
Figure 8:
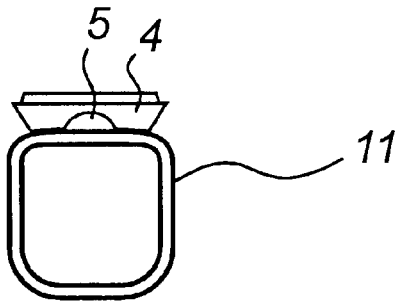
FIG. 8 is an end view of a removable cap provided with a clip having a hole for engagement with a pen point.

According to FIGS. 2B and 8, the squeezing engagement can be performed by interaction between two parts, such as a holding part 7 and a counterflange 9 of the clip in FIG. 2B, or the cap 11 and the clip 4 in FIG. 8.

Figure 3:
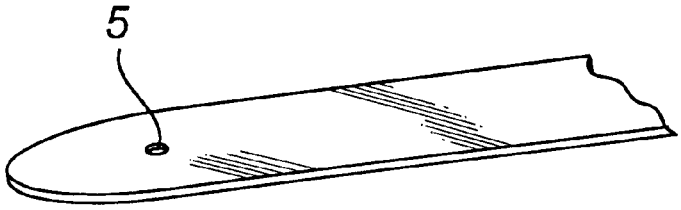
FIG. 3 is a perspective view of a clip with a hole in its flat side.
Figure 4:
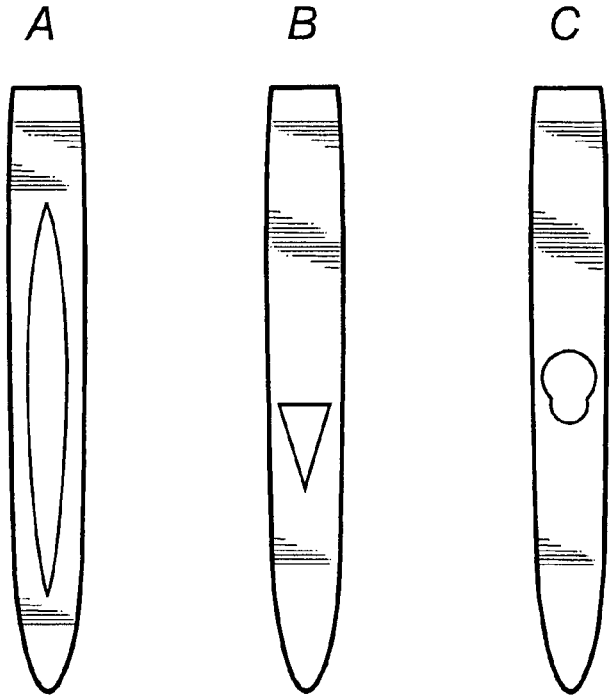
FIGS. 4A–C are plan views of clips with holes according to three different embodiments.

According to the embodiments where the means arranged on the movable part 4 is a hole 5, this is formed so that it may be caused, by squeezing action, to engage the pen point 3 for extraction thereof. The hole 5 is dimensioned, so that by exerting a force, for instance a frictional force, it may temporarily hold the pen point 3 to allow removal thereof from the pen body. The hole may have different shapes. A simple embodiment is shown in FIG. 3, where the hole is essentially circular. According to an alternative embodiment, shown in FIG. 4A, the hole is elongate and has wedge-shaped end portions. In the embodiment according to FIG. 4B, the hole is formed as a triangle, and in the embodiment according to FIG. 4C, the hole has the form of a "keyhole".

Figure 5:
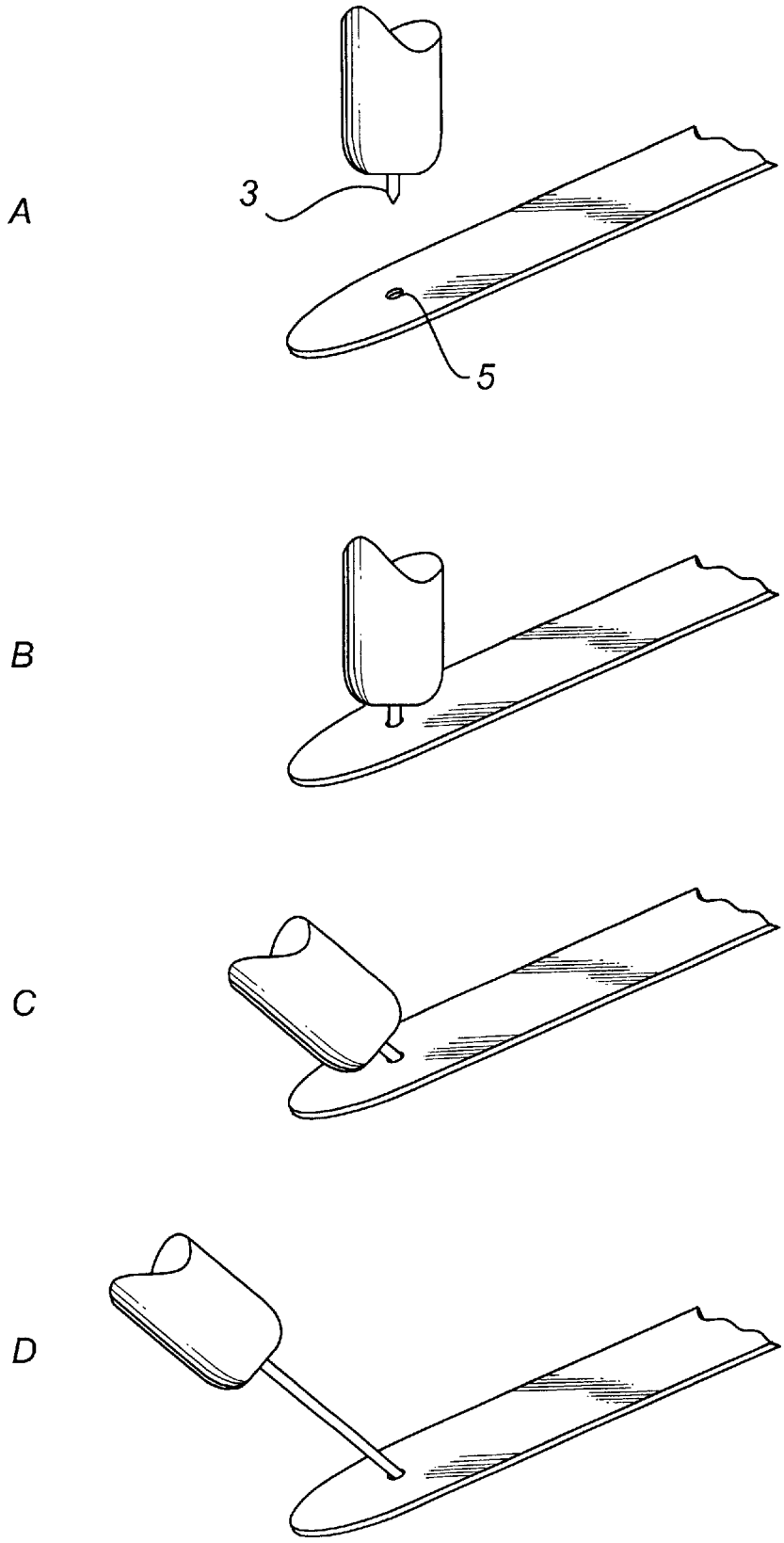
FIGS. 5A–5D are a sequence of perspective views to illustrate an embodiment of a method for removing a pen point according to the invention.

With reference to FIG. 5, it is shown how a hole 5 as described above can be used to remove the pen point 3, and thus optionally the entire ink stick, from the pen body. The pen point 3 is caused to engage in the hole 5 by inclination/angling of these two relative to each other. In step B, the pen point 3 is placed in the hole. In step C, the pen body is angled so that the pen point 3 is fastened in the hole 5, and in step D the pen point/ink stick is extracted. The actions that are taken in step C are modifiable according to the appearance of function of the hole. The engagement between the clip and the pen point may be used to remove the latter by unscrewing it from the pen body.

The clip 4 may be formed as a separate elongate holding part 7 (FIG. 2), which at one end is attached to the pen body or a protective cap and which at its other end possibly has a bend 6 or bead which acts to better hold the pen in place when carried, for instance, in a user's pocket. The elongate holding part 7 of the clip may be elongate, for instance rectangular, in cross-section, so that a flat side is formed, as is evident from FIGS. 3–5.

According to an embodiment, which is shown in FIG. 2A, the clip has a fixing flange 8, which makes an angle with the elongate holding part 7 of the clip. The angle may be right, but other, larger or smaller, angles are feasible. The fixing flange 8 can be releasably anchored to the pen body 1 at the rear end thereof, for instance by means of a screw, a locking pin, a snap connection, via a press fit or some other fixing means having an equivalent function. Alternatively, the fixing flange 8 may correspondingly be releasably anchored in a groove extending transversely of the longitudinal direction of the pen, which groove may be formed in the pen body 1 or the protective cap 11. The clip in FIG. 2A has a hole 5 in the fixing flange 8, in the form of a through hole or a blind hole for the above engagement with the pen point 3. Alternatively (not shown), the hole 5 may be formed in the holding part 7.

As an alternative to the hole, a counterflange 9 can be arranged, as shown in FIG. 2B, to extend under the bend 6 of the clip at a distance therefrom and be connected with the holding part 7, possibly via a fixing flange 8 as described above. When removing the pen point/ink stick, the pen point is inserted into a variable gap 10 which is defined between the bend 6 of the clip and the counterflange 9, the engagement being provided by pressing together the bend 6 of the clip and the counterflange 9, like the jaws of a pair of pliers or the legs of a pair of tweezers. It will be appreciated that the bend 6 of the clip can be formed in various ways, to provide a desired squeezing effect and to improve the holding of the pen when carried, for instance, in a pocket.

According to an embodiment (not shown), a projection may be arranged adjacent to the gap, on the holding part 7 and/or on the counterflange 9, the engagement being performed or facilitated by means of this projection, which may have, for instance, a sharp edge, a hole of a shape adapted to the general cross-section of pen points, etc.

According to another variant, a variable gap may be formed in the flat side of the clip. For instance, a hole of the type shown in FIG. 4A may serve as such a gap, with a suitable selection of material and material thickness around the hole.

Figure 2C:
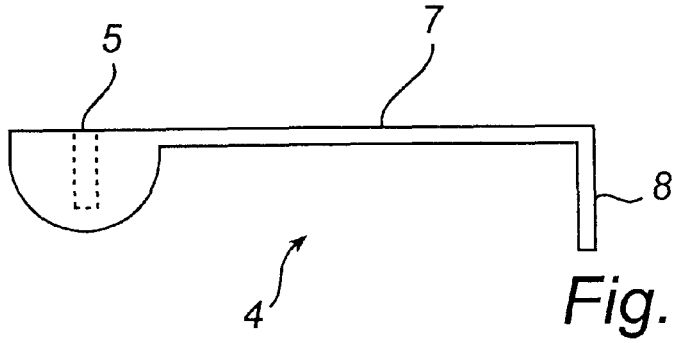

According to an embodiment as shown in FIG. 2C, there is a hole 5 in the form of a blind hole in the clip, so formed that the pen point 3 can be caused to engage the boundary surfaces of the hole. Also in this embodiment, the hole may have a cross-section varying in depth.

Figure 6:
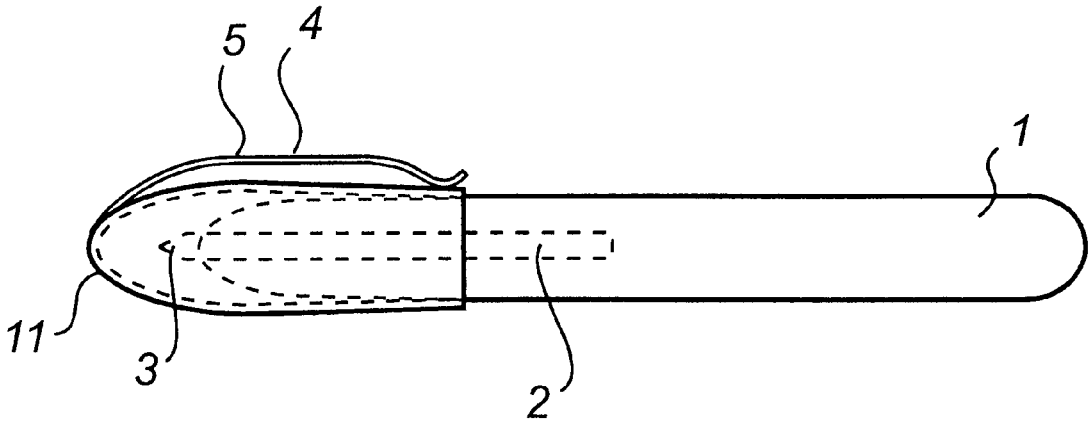
FIG. 6 is side view of one more embodiment of a pen according to the invention with inner parts indicated by dashed lines.

With reference to FIG. 6, one more embodiment of a pen according to the invention is shown, in which the part 4, which is removably arranged on the pen body 1, is a protective cap 11 with a clip 4. This clip may, like in the embodiments described with reference to FIGS. 1–4, has a hole 5 on its flat side in the form of one or more through holes or blind holes. Such a clip may be formed in one piece with the protective cap 11, or as a separate part.

Figure 7:
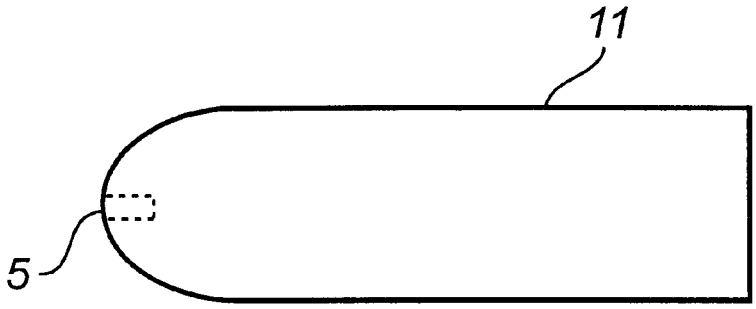
FIG. 7 is a side view of a removable cap according to an embodiment of the invention.

An alternative is shown in FIG. 7, viz. a cap 11 with an engaging hole 5 in its one, normally closed end. It will be appreciated that the hole 5 can either be a blind hole or a through hole, and that the hole 5 can be arranged in an arbitrary position in the cap 11.

With reference to FIG. 8, which shows one end of a cap with a clip 4, seen from the open end of the cap, there may be formed according to a further alternative, on the underside of the clip 4 at its distal end, a projection with a hole 5 for engaging the pen point projecting from the pen body.

Alternatively or besides (not shown), the projection can be formed on the pen body to define said hole 5. For removing the pen point or the ink stick, the pen point can be inserted into the hole 5, after which the cap 11 and the pen body 1 are angled to each other to provide the engagement similarly to the above embodiments involving a through hole or a blind hole.

According to an alternative to the embodiment in FIG. 8, a variable gap may be formed between the clip 4 and the cap 11, for instance at the distal end of the cap as illustrated in FIG. 8, or along the extent of the clip along the peripheral surface of the cap (cf. the space between the clip and the cap in the side view in FIG. 6). In order to remove the pen point, this is inserted into the gap, from the short side or long side of the cap, after which the user can press the clip against the cap to provide the squeezing engagement with the pen point, like the jaws of a pair of pliers or the legs of a pair of tweezers. According to one variant (not shown), a projection can be formed adjacent to the gap, on the clip and/or on the cap, the engagement being provided or facilitated by means of this projection, which may have, for instance, a sharp edge, a hole of a shape adapted to the general cross-section of pen points, etc.

Finally, it should be emphasized that the invention is not limited to the embodiments described and may be varied within the scope of the appended claims.

What I claim and desire to secure by Letters Patent is:

1. A pen comprising:

a pen body;

a pen point which is releasably arranged in the pen body;

a removable cap which protects the pen point; and a clip which is arranged on the cap with a flat side facing away from the cap, a through hole being defined by a clip portion in said flat side, wherein the through hole provides for insertion and angling of the pen point to bring it into squeezing engagement therewith, whereby the pen point is removable from the pen body by the action of forces between the clip portion and the pen point.

2. A pen as claimed in claim 1, wherein the pen point together with an ink cartridge forms an ink stick, which is arranged to be removed from the pen as the pen point is being removed.

3. A pen as claimed in claim 1, wherein the through hole is elongate.

4. A pen as claimed in claim 1, wherein the through hole is triangular.

5. A pen as claimed in claim 1, wherein the through hole has the form of a keyhole.

6. A method for removing a pen point in a pen comprising a pen body and a pen part which is removably arranged on the pen body, said method comprising the steps of:

removing the pen part from the pen body;

inserting the pen point into a through hole defined by a portion of the pen part;

bringing the pen point into squeezing engagement with said portion by angling of the pen point and the pen part relative to each other; and manipulating the pen part to extract the pen point from the pen body under action of forces between said portion and the pen point.

7. A method as claimed in claim 6, wherein said step of removing comprises removing a clip from the pen body, the through hole being defined in a flat side thereof.

8. A pen comprising:

a pen body;

a pen point which is releasably arranged in the pen body; and a clip which is detachably arranged on the pen body, a through hole being defined in a portion of the clip, wherein the through hole provides for insertion and angling of the pen point to bring it into squeezing engagement therewith, whereby the pen point is removable by the action of forces between the clip portion and the pen point.

9. A pen as claimed in claim 8, wherein the clip comprises an elongate holding part extending along a portion of the pen body, and a fixing flange making an angle with the holding part, the fixing flange being releasably arranged on the pen body at the rear end thereof, wherein said through hole is defined in the fixing flange for said engagement with the pen point.

10. A pen as claimed in claim 8, wherein the clip comprises an elongate holding part extending along a portion of the pen body, wherein said through hole is defined in the elongate holding part for said engagement with the pen point.

11. A pen as claimed in claim 8, wherein the pen point is releasably arranged in the pen body such that application of a frictional force on said pen point by said squeezing engagement and a pulling force on said clip extracts the pen point from the pen body.

12. A dual-function clip for holding a pen when carried in a user's pocket and for removing a pen point arranged in the pen body, said dual-function clip comprising:

an elongate holding part; and an engaging means in the form of a through hole which is defined by a portion of the holding part, wherein the through hole provides for insertion and angling of the pen point to bring it into squeezing engagement therewith, whereby the pen point is removable from the pen body by the action of forces between the engagement means and the pen point.

13. A dual-function clip as claimed in claim 12, further comprising a fixing means for releasable fixing of the clip to a pen body.

14. A method as claimed in claim 6, wherein said step of manipulating comprises applying, by means of said squeezing engagement, a frictional force on the pen point, and exerting a pulling force on said pen part so as to extract the pen point from the pen body.

15. A method as claimed in claim 14, wherein the frictional force is exerted on an essentially smooth peripheral surface of the pen point.

16. A pen as claimed in claim 1, wherein the pen point is releasably arranged in the pen body such that application of a frictional force on said pen point by said squeezing engagement and a pulling force on said clip extracts the pen point from the pen body.

* * * * *